US008739347B2

(12) United States Patent
Lin

(10) Patent No.: US 8,739,347 B2
(45) Date of Patent: Jun. 3, 2014

(54) SPIRAL DRIVE MECHANISM AND SPIN MOP WITH THE SAME

(75) Inventor: Yi-Pin Lin, Taichung (TW)

(73) Assignees: Yen-Tan Lin, Taichung (TW); Dyna-Mop, Inc., Taipei (TW)

( * ) Notice: Subject to any disclaimer, the term of this patent is extended or adjusted under 35 U.S.C. 154(b) by 108 days.

(21) Appl. No.: 13/557,193

(22) Filed: Jul. 24, 2012

(65) Prior Publication Data

US 2013/0036563 A1 Feb. 14, 2013

(30) Foreign Application Priority Data

Aug. 8, 2011 (TW) ..... 100128226 A

(51) Int. Cl.
*A47L 13/14* (2006.01)

(52) U.S. Cl.
USPC ..... 15/119.1; 15/25; 34/58; 74/29; 74/34

(58) Field of Classification Search
USPC ..... 15/25, 26, 119.1, 120.1, 120.2, 154.2; 34/58; 74/29–35; 81/51, 57.3, 57.31, 81/57.39, DIG. 2; 173/213, 170, 29, 173/109–111; 366/129; 408/121, 124
See application file for complete search history.

(56) References Cited

U.S. PATENT DOCUMENTS

| | | | | |
|---|---|---|---|---|
| 452,617 | A * | 5/1891 | Satterlee | 81/57.39 |
| 2010/0287722 | A1* | 11/2010 | Yu | 15/228 |
| 2011/0239389 | A1* | 10/2011 | Ting | 15/120.2 |
| 2012/0167321 | A1* | 7/2012 | Lee | 15/119.2 |

* cited by examiner

*Primary Examiner* — Mark Spisich

(57) ABSTRACT

A spin mop includes a spiral drive mechanism and a mop head. The spiral drive mechanism includes an upper rod, a sleeve axially secured on the upper rod, a stopper secured in the sleeve, two thread rolling plates positioned in the upper rod, a guide block, a lower rod axially inserted in the upper rod, and a follower secured on a top end of the lower rod. The guide block is placed in between the two thread rolling plates so that the guide block is movable in a spiral direction with respect to the upper rod. The follower is configured to be selectively driven by the guide block so that the follower together with the lower rod is rotatable with the guide block.

11 Claims, 11 Drawing Sheets

SPIRAL DRIVE MECHANISM AND SPIN MOP WITH THE SAME

BACKGROUND OF THE INVENTION

1. Field of the Invention

The present invention relates to a spiral drive mechanism and a spin mop using the same and more particularly to a spiral drive mechanism which can be fabricated in a rapid, efficient and cost-effective manner.

2. Description of the Related Art

Cleaning a floor with a mop and bucket is a basic household cleaning chore. However, cleaning floors with a traditional mop and bucket can be really tiring and hard work. The mop needs continual rewetting in the bucket and wringing out the mop by hand twisting the strings of the mop head. To turn the cleaning job to one that is quick and easy, some disclose a spin mop, which allows a user to clean the floor with relatively little effort. Specifically, the spin mop is equipped with a spinning device to spin a mop head of the spin mop so as to draw liquid away from the strings of the mop head by a centrifugal force generated by rotation of the mop head.

As shown in FIG. 13, a conventional spin mop 900 is equipped with a spiral drive mechanism, a lower rod 94 and a mop head 95. The spiral drive mechanism generally includes a tube body 90, a guide screw 91 placed within the tube body 90, a pin 93 and a follower 92 to which the lower rod 94 and the mop head 95 are connected. The tube body 90 is formed with a series of knobs 901 in an inner peripheral wall for spiral movement of the guide screw 91. The follower 92 is connected to the guide screw 91 by means of the pin 93 such that when the guide screw 91 moves in a spiral direction with respect to the tube body 90, the follower 92 rotates with the guide screw 91 so as to have the lower rod 94 and the mop head 95 spin. In this manner, liquid can be extracted out from the strings of the mop head 95 by a centrifugal force generated by rotation of the mop head 95.

However, the aforementioned spiral drive mechanism cannot be easy to manufacture because the knobs 901 can be hardly formed in a tubular body with metal material by molding in order to form the tube body 90. In practice, two half shells with knobs 901 thereon will have to be provided first by molding and then be weld together so as to form the tube body 90. Alternatively, the metal tube body 90 with knobs 901 may be replaced by a plastic tube body which is less difficult to make by molding; however, the strength of the plastic tube body is relatively weaker than that of the metal tube body.

SUMMARY OF THE INVENTION

The present invention provides an improved spin mop to solve the problems mentioned above. In particular, the spin mop is equipped with a spiral drive mechanism that is easy to manufacture and great in strength.

The spin mop includes an upper rod, a sleeve axially secured around the upper rod, a stopper secured in the sleeve, two thread rolling plates positioned in the upper rod, a guide block movably mounted in between the two thread rolling plates, a lower rod axially inserted in the upper rod, a follower secured on a top end of the lower rod, a connection mechanism; and a mop head connected to a bottom end of the lower rod by means of the connection mechanism.

Specifically, the upper rod includes a tube body, a tube extension extending from a bottom of the tube body and an annular shoulder defined at the junction of the tube body and the tube extension. The tube body of the upper rod has two sets of longitudinal ribs on inner walls thereof at two opposite sides, and each set of the ribs defines a dovetail groove. The sleeve is axially secured around an upper portion of the tube body of the upper rod. The stopper is secured in the sleeve and has a recess defined in a bottom thereof and a flange formed at bottom edge thereof. The two thread rolling plates are spaced apart and securely fitted in the respective dovetail grooves of the tube body of the upper rod and co-define a threaded passage therebetween. And, the two thread rolling plates are held in between the annular shoulder of the upper rod and the flange of the stopper.

The guide block has a helical thread line formed on a periphery thereof and is placed in the threaded passage of the two thread rolling plates such that the guide block is movable in a spiral direction with respect to the two thread rolling plates. The follower is provided to be selectively driven by the guide block. When the guide block is received in the recess of the stopper, the guide block is kept from driving the follower to rotate; and when the guide block is withdrawn from the recess of the stopper, the guide block is free to drive the follower together with the lower rod to rotate.

In accordance with one embodiment, the guide block further has an axial bore defined from top to bottom thereof and a conical recess having teeth grooves at a bottom thereof. The conical recess of the guide block is in communication with the axial bore of the guide block. The follower includes a cone body with teeth thereon to be fitted in the conical recess of the guide block and a post which extends from the cone body and is slidingly mounted in the axial bore of the guide block. A spring may be included and disposed in the axial bore of the guide block and sleeved on the post of the follower.

In accordance with another embodiment, the guide block includes a clutch member and a cylindrical body with the helical thread line thereon. The clutch member of the guide block includes a disc, two pawls disposed at opposite sides of the disk and a threaded portion extending upwardly from the center of the disk. The cylindrical body of the guide block defines at a bottom thereof a threaded hole into which the threaded portion of the clutch member is screwed. The follower is a ratchet ring with internal teeth for engagement with the pawls of the clutch member.

Further benefits and advantages of the present invention will become apparent after a careful reading of the detailed description with appropriate reference to the accompanying drawings.

DETAILED DESCRIPTION OF EMBODIMENTS

Figure 1:
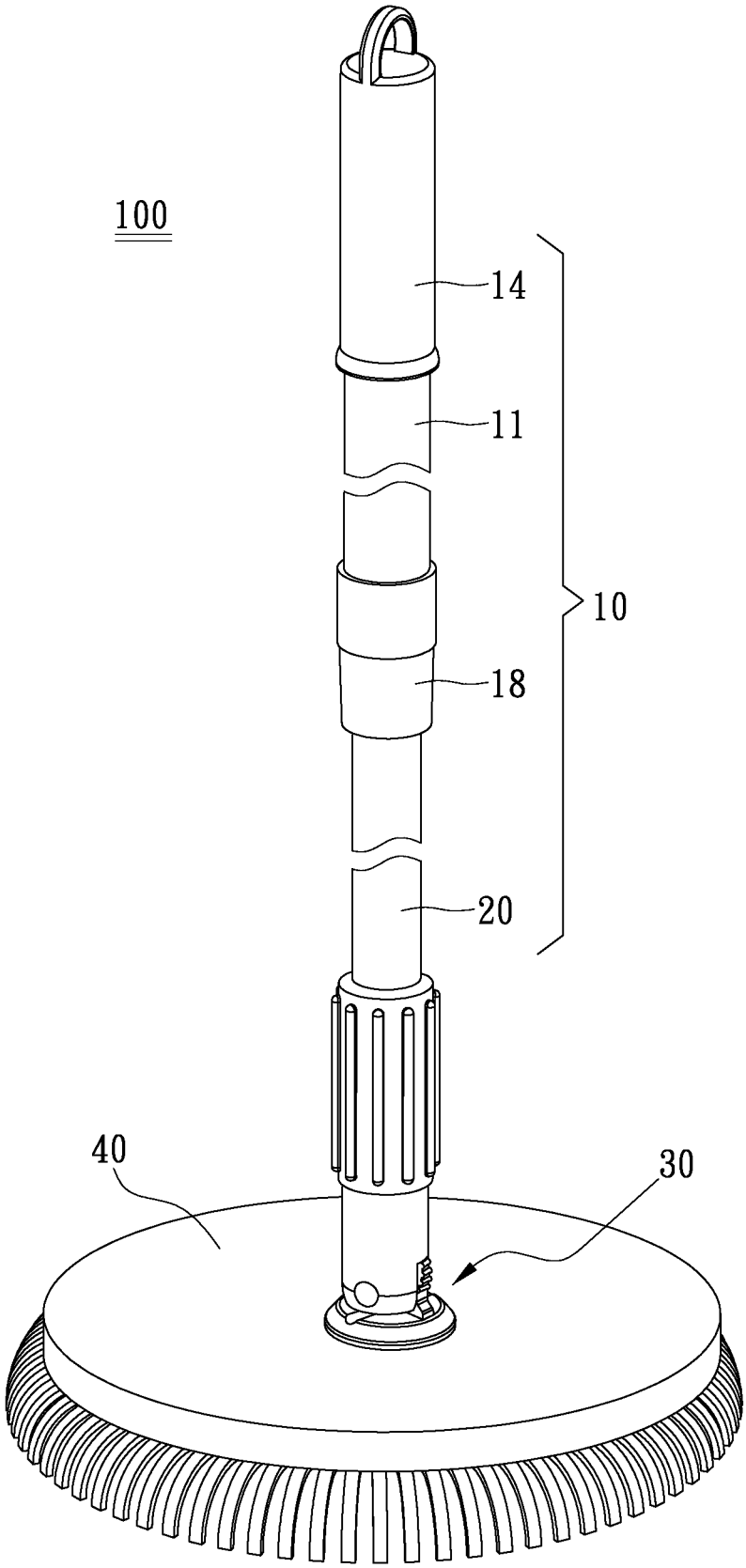
FIG. 1 is a perspective view of a spin mop in accordance with a first embodiment of the present invention.

Referring to the drawings and initially to FIGS. 1-7, a spin mop 100 is provided in accordance with a first embodiment of the present invention. As shown in FIG. 1, the spin mop 100 includes a spiral drive mechanism 10, a mop head 40 and a connection mechanism 30 connecting the spiral drive mechanism 10 and the mop head 40.

Figure 2:
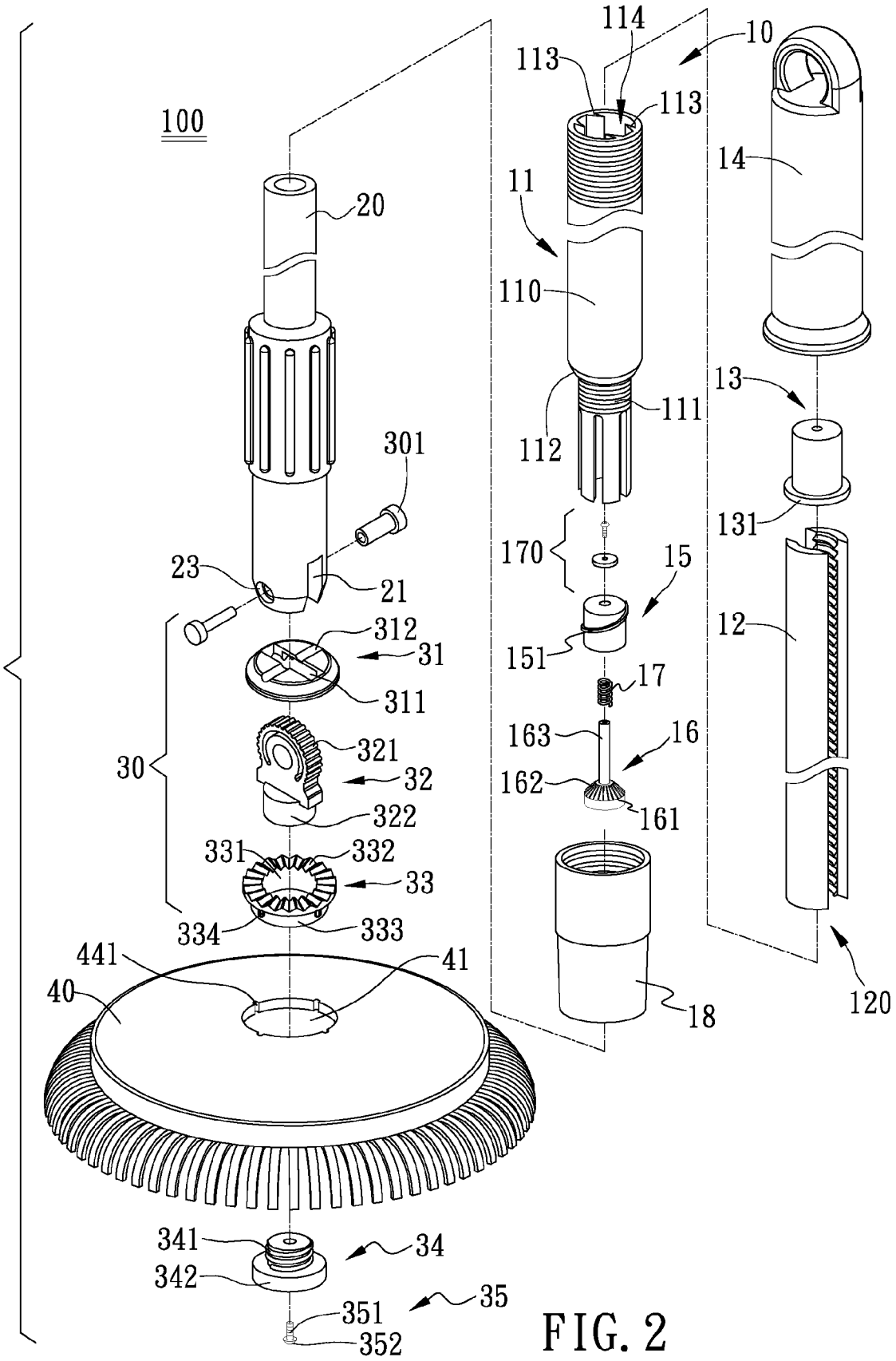
FIG. 2 is an exploded perspective view of the spin mop shown in FIG. 1.

Referring to FIG. 2, the spiral drive mechanism 10 includes a sleeve 14, a stopper 13 secured within the sleeve 14, two thread rolling plates 12, an upper rod 11 in which the two thread rolling plates 12 are positioned, a guide block 15 placed in between the two thread rolling plates 12, a follower 16 inserted in the guide block 15, a spring 17 disposed in the guide block 15, a collar 18 joined to a lower portion of the upper rod 11, and a lower rod 20 axially inserted into the collar 18 as well as the upper rod 11.

Figure 3:
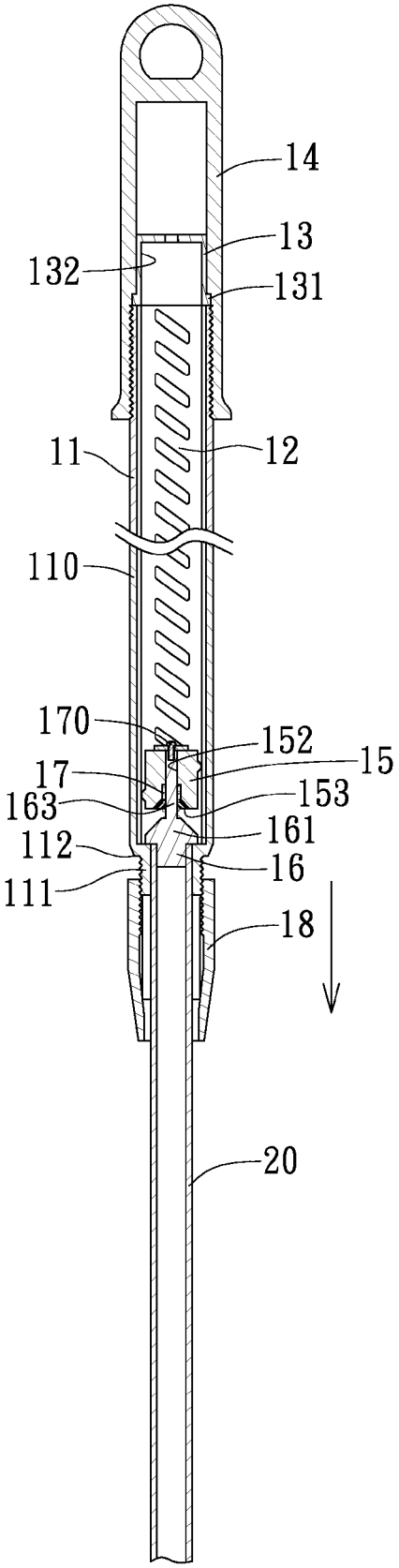
FIGS. 3-6 are partial enlarged cross-sectional views of the spin mop shown in FIG. 1, showing the process of operating the spin mop.

Specifically, the upper rod 11 includes a tube body 110, a tube extension 111 extending from a bottom of the tube body 110 and an annular shoulder 112 defined at the junction of the tube body 110 and the tube extension 111. As shown in FIGS. 2 and 3, the sleeve 14 is axially secured around an upper portion of the tube body 110 of the upper rod 11. The stopper 13 has a recess 132 defined in a bottom thereof and a flange 131 formed at bottom edge thereof. The tube body 110 has inner walls formed with two sets of longitudinal ribs 113 at two opposite sides, and each set of the ribs 113 defines a dovetail groove 114.

Figure 13:
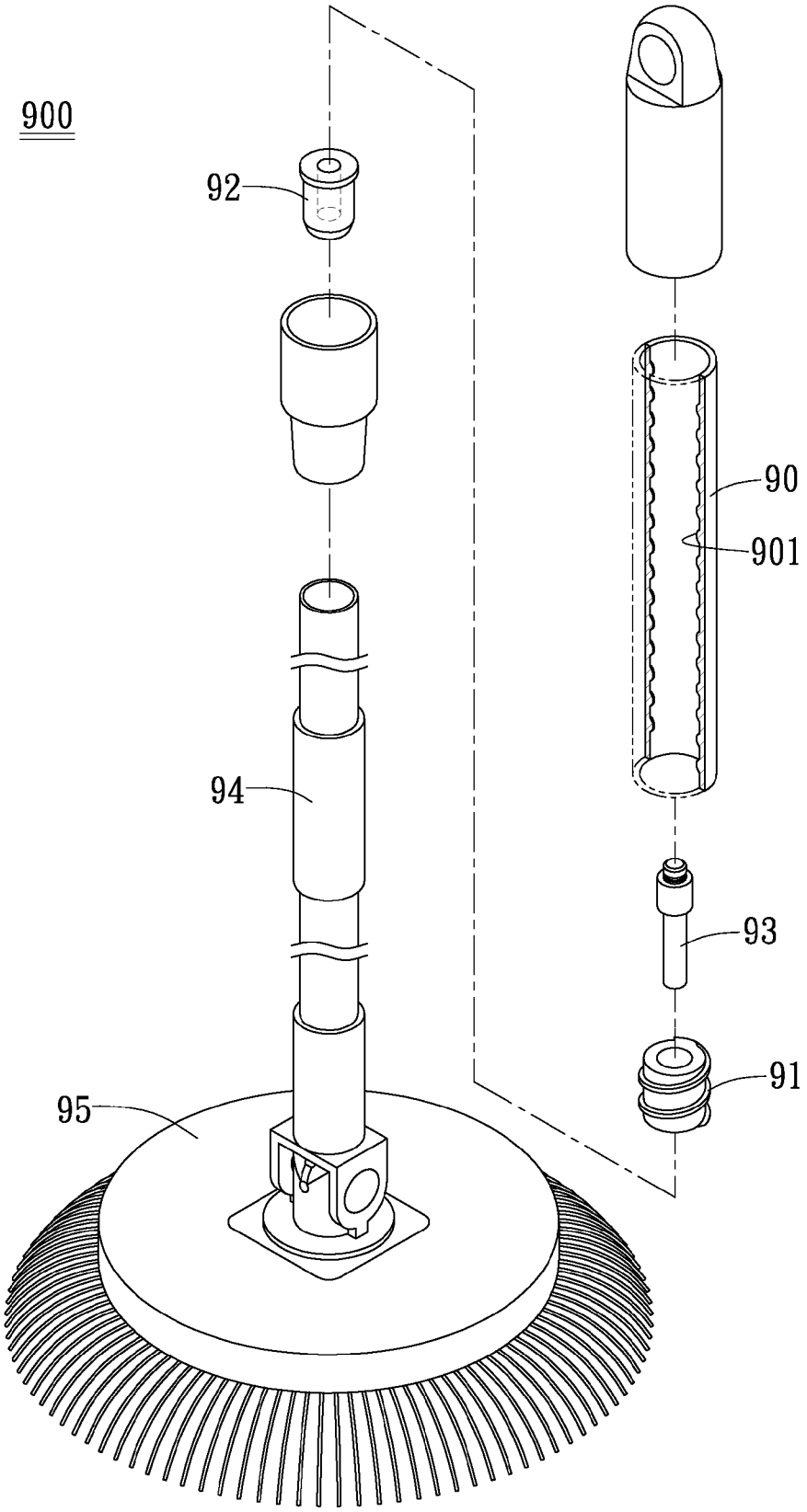
FIG. 13 PRIOR ART
FIG. 13 is a prior art.

As shown in FIGS. 2 and 3, the two thread rolling plates 12 are spaced apart and securely fitted in the respective dovetail grooves 114 of the tube body 110 of the upper rod 11 and vertically held in between the annular shoulder 112 of the upper rod 11 and the flange 131 of the stopper 13. Moreover, the two thread rolling plates 12 together define a threaded passage 120 therebetween where the guide block 15 is placed. The guide block 15 has a helical thread line 151 on a periphery thereof so as to be movable in a spiral direction with respect to the thread rolling plates 12. Compared to the prior art tube body 90 with the knobs 901 in FIG. 13, the combination of the tube body 110 (with the ribs 113 in a longitudinal direction) and the thread rolling plates 12 are relatively less difficult to be fabricated since the tube body 110 and the thread rolling plates 12 can be made separately by molding and then easily assembled together.

The follower 16 is secured on a top end of the lower rod 20 and is selectively driven by the guide block 15 to rotate, as will be discussed in detail later. The collar 18 has its upper end screwed on the tube extension 111 of the upper rod 11 and is configured to selectively grasp or release the lower rod 20 therefrom. As shown in FIG. 3, the lower rod 20 is released from the collar 18 so that the lower rod 20 together with the follower 16 is allowed to rotate with respect to the upper rod 11. On the contrary, if the collar 18 is screwed upwardly to firmly grasp the lower rod 20 (not shown) with its inner walls, the lower rod 20 and the follower 16 will be retained from rotating with respect to the upper rod 11.

Figure 4:
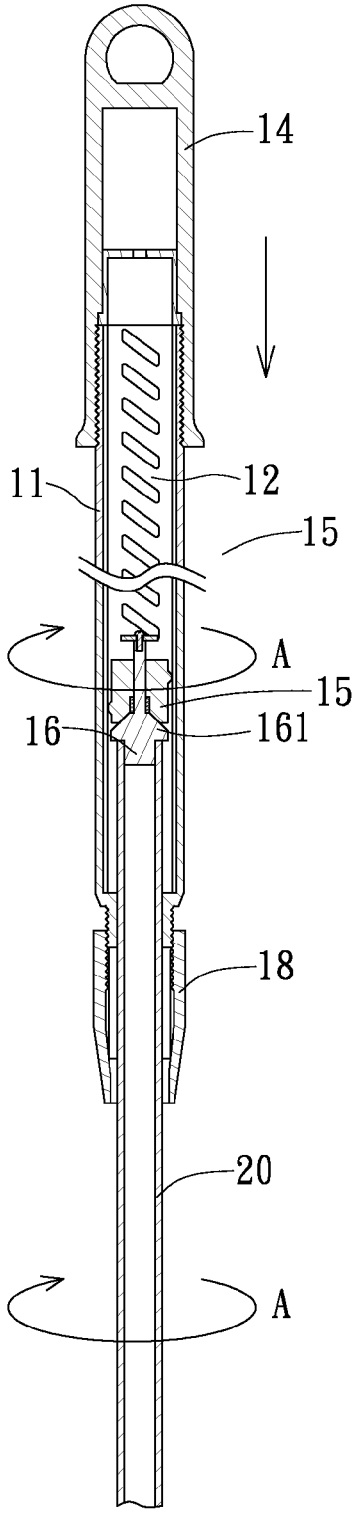

Referring again to FIG. 3, the guide block 15 further has an axial bore 152 defined from top to bottom thereof and a conical recess 153 having teeth grooves at a bottom thereof. The conical recess 153 of the guide block 15 is in communication with the axial bore 152 of the guide block 15. On the other hand, as best seen in FIG. 2, the follower 16 includes a cone body 161 and a post 163 extending from a top of the cone body 161 and being slidingly mounted in the axial bore 152 of the guide block 15 by means of fixing members 170. The spring 17 is sleeved on the post 163 of the follower 16 and is disposed in the axial bore 152 of the guide block 15. The cone body 161 of the follower 16 has teeth 162 at a top thereof corresponding to the teeth grooves of the conical recess 153 of the guide block 15 for teeth engagement between the follower 16 and the guide block 15, as depicted in FIG. 4. Thus, when the guide block 15 is engaged with the cone body 161 of the follower 16, the guide block 15 is able to drive the follower 16 as well as the lower rod 20 and the lowermost mop head 40 to rotate.

Figure 8:
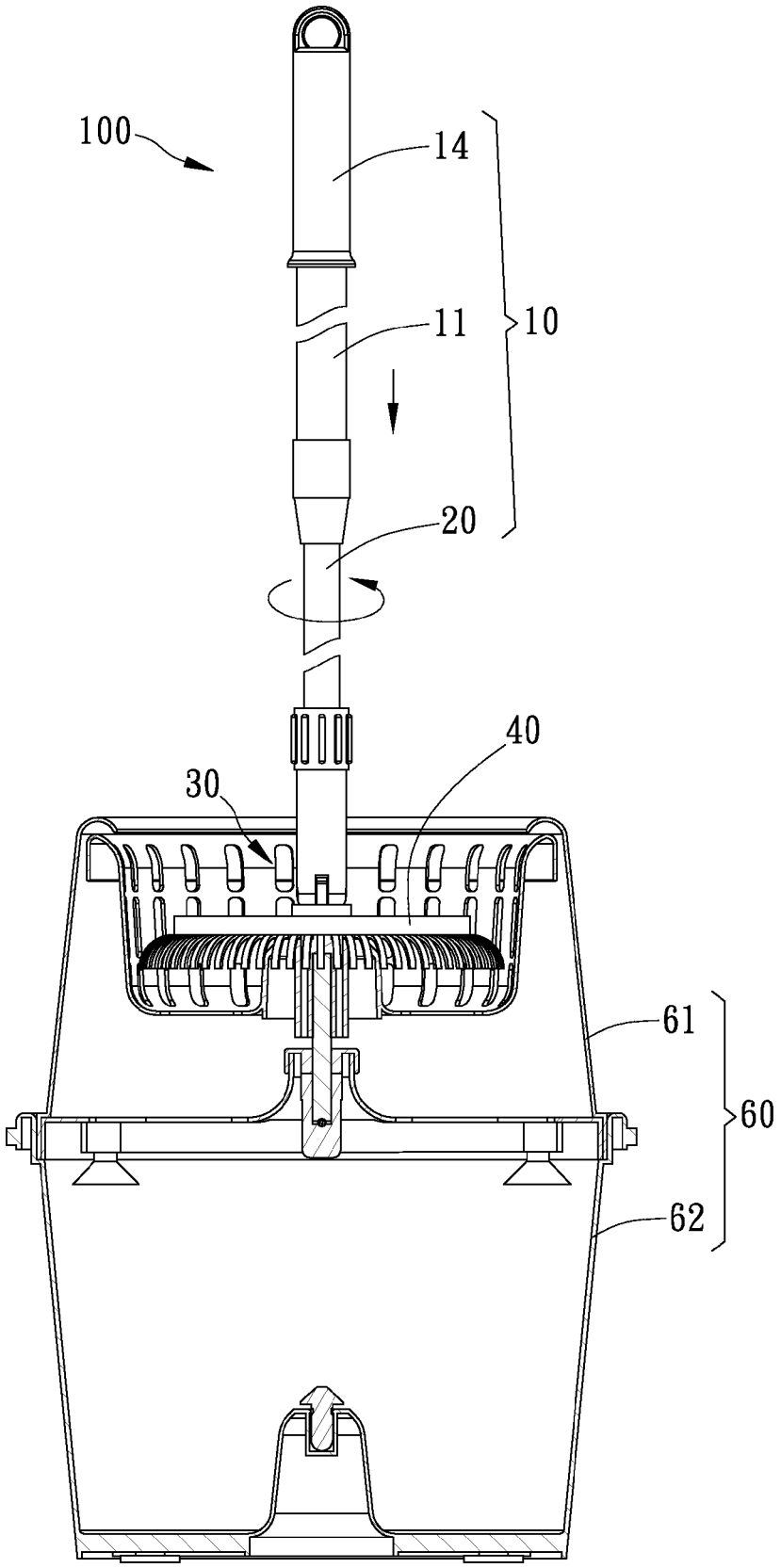
FIG. 8 illustrates the spin mop is inserted in a mop bucket including an upper wringer basket and a lower basin.
Figure 9:
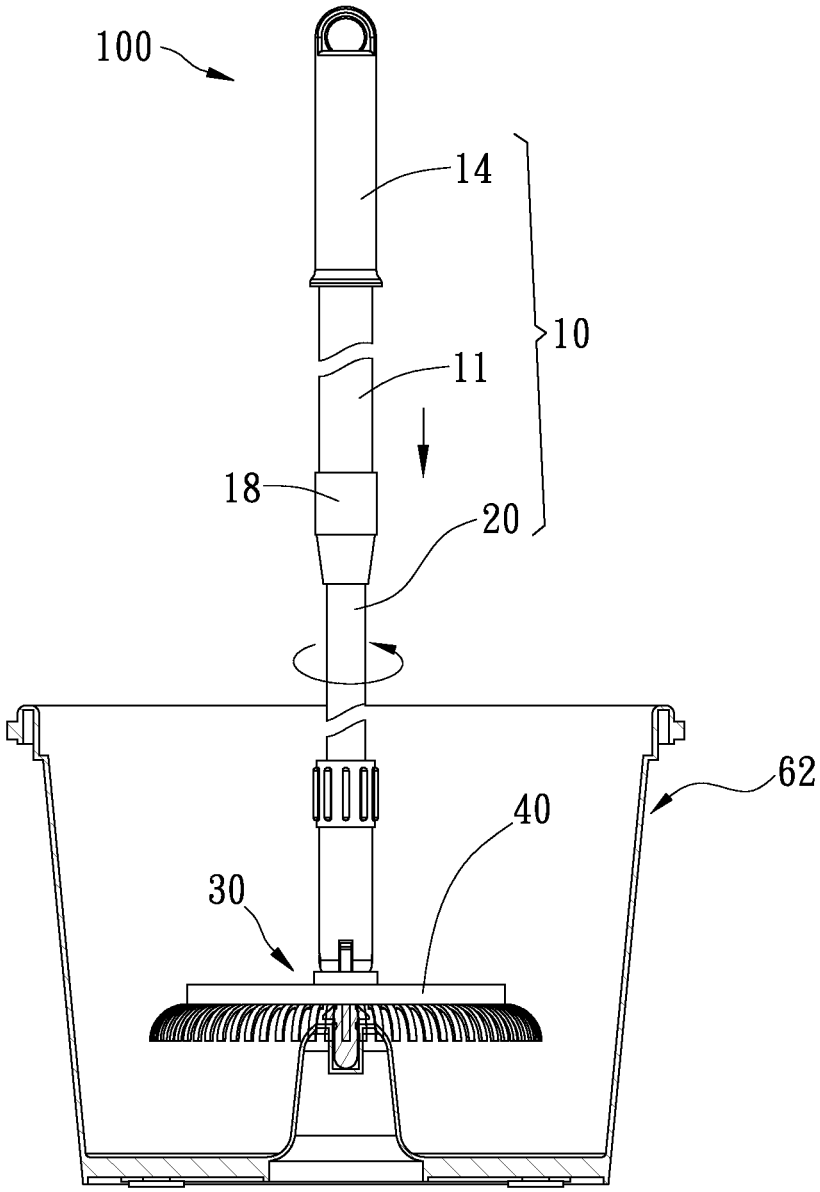
FIG. 9 illustrates the spin mop is inserted directly in the lower basin of the mop bucket shown in FIG. 8.

In use, the spin mop 100 may be placed in a rotatable wringer basket 61 of a mop bucket 60, as shown in FIG. 8, for further dehydration. Liquid extracted from the wringer basket 61 may be collected in a lower basin 62 of the mop bucket 60. Alternatively, without using the wringer basket 61, the spin mop 100 may be directly placed in the lower basin 62 of the mop bucket 60, as shown in FIG. 9, for further dehydration. In operation, the upper rod 11 of the spin mop 100 should be first axially pressed down with respect to the lower rod 20 in order to have the mop head 40 spins. Afterward, the upper rod 11 is pulled up for next downward pressing, and so on.

Specifically, before using the mop bucket 60 for dehydration, a user should first loosen the collar 18 of the spin mop 100 to release the lower rod 20, as shown in FIG. 3, so that the lower rod 20 is allowed to spin. It is noted that in FIG. 3 the follower 16 is not teeth-engaged with the guide block 15 yet. Next, the upper rod 11 together with the sleeve 14 is pressed down by application of a little force until the guide block 15 is engaged with the cone body 161 of the follower 16, as depicted in FIG. 4. Afterward, pushing the upper rod 11 down further will have the guide block 15 start to rotate with respect to the two thread rolling plates 12 and drive the follower 16 together with the lower rod 20 to rotate in a clockwise direction A. At this time, the mop head 40 spins and liquid starts to be drawn away from the mop head 40 by a centrifugal force generated by rotation of the mop head 40.

Figure 5:
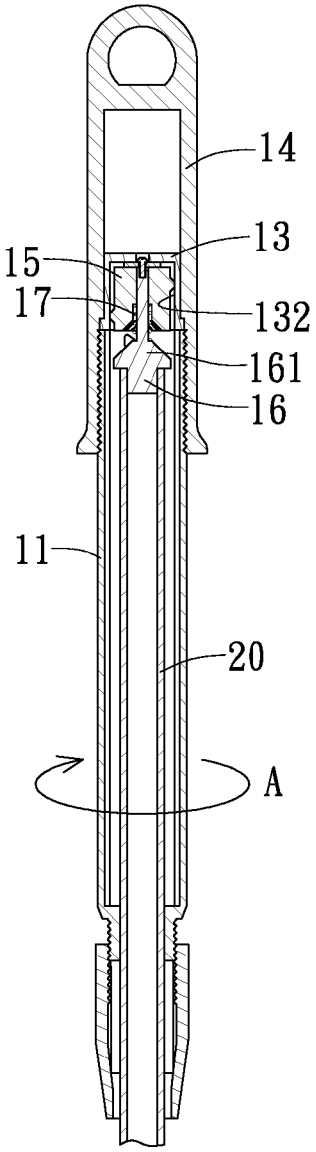
Figure 6:
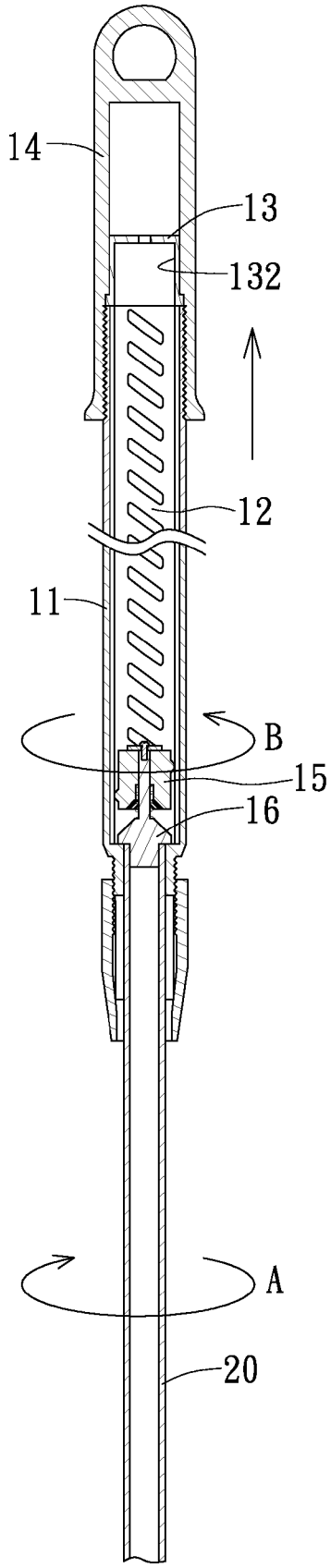

Upon the upper rod 11 is pushed down to a position where the guide block 15 is blocked and enclosed by the stopper 13, as shown in FIG. 5, the guide block 15 is departed from the threaded passage 120 of the thread rolling plates 12 and is no more guided by the thread rolling plates 12. Moreover, the cone body 161 of the follower 16 is pushed down by a restoration force of the spring 17 so that the guide block 15 stops driving the follower 16. Referring to FIG. 6, while the upper rod 11 is lifted up with respect to the lower rod 20, the guide block 15 rotates in a counterclockwise direction B. Since the guide block 15 is no more teeth-engaged with the follower 16, rotation of the guide block 15 in the counterclockwise direction B will not affect the follower 16 which remains spinning in the clockwise direction A due to the inertia.

As noted above, the follower 16 is selectively driven by the guide block 15. That is, when the guide block 15 is received in the recess 132 of the stopper 13, as shown in FIG. 5, the guide block 15 is kept from driving the follower 16 to rotate; and when the guide block 15 is withdrawn from the recess 132 of the stopper 13, the guide block 15 is free to drive the follower 16 together with the lower rod 20 to rotate, as shown in FIG. 4.

Figure 7:
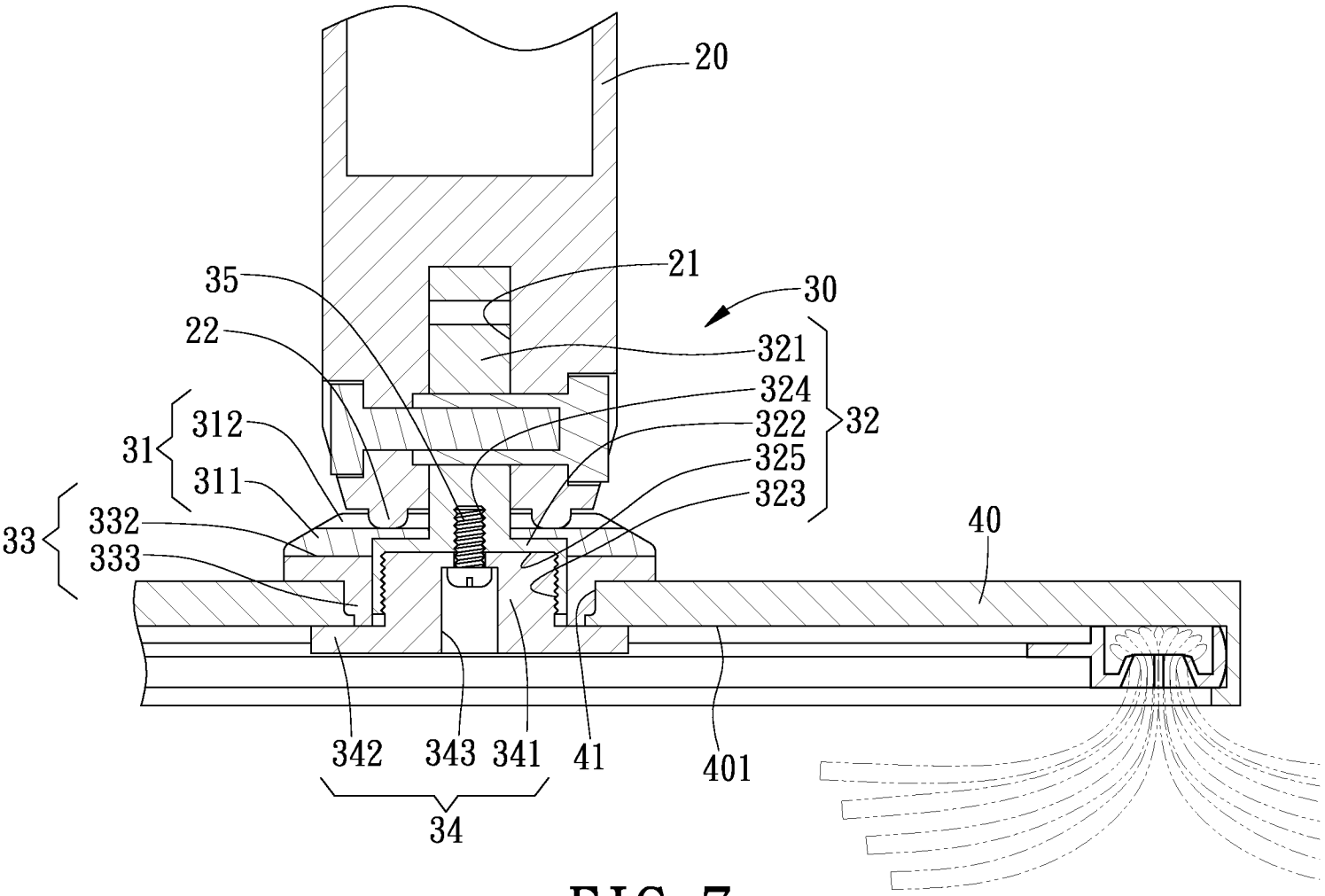
FIG. 7 is a partial enlarged cross-sectional view of the spin mop shown in FIG. 1, showing a lower portion of the spin mop.

Referring to FIGS. 2 and 7, the mop head 40 is connected to a bottom end of the lower rod 20 by means of the connection mechanism 30. Specifically, the lower rod 20 defines at its bottom end a receiving recess 21 and a pivot hole 23 intersecting with the receiving recess 21. Moreover, the lower rod 20 has two studs 22 (see FIG. 7) protruded at a bottom thereof and arranged in a line normal to the receiving recess 21 of the lower rod 20. On the other hand, the connection mechanism 30 includes a pivot pin 301 positioned in the pivot hole 23 of the lower rod 20, a circular plate 31, a connecting member 32, an adaptor 33, a first fastener 34 and a second fastener 35.

As shown in FIG. 2, the circular plate 31 has a through bore 311 from top to bottom along a first diametrical direction, a trough 312 in a top surface thereof along a second diametrical direction normal to the first diametrical direction, and annular teeth at a bottom thereof (not shown). When the two studs 22 of the lower rod 20 are both well seated in the trough 312 of the circular plate 31, as shown in FIG. 7, the lower rod 20 is exactly positioned normal to the mop head 40, ensuring that the mop head 40 can spin smoothly.

Referring to FIGS. 2 and 7, the connecting member 32 has one end portion 321 pivotally mounted to the bottom end of the lower rod 20 by means of the pivot pin 301, and the other end portion 322 defining a first threaded hole 323, a second threaded hole 324 and a shoulder 325 formed at the junction of the first threaded hole 323 and the second threaded hole 324. The adaptor 33 is placed around the other end portion 322 of the connecting member 32 and has a shaft portion 333 at a bottom thereof and annular teeth 332 at a top thereof. The annular teeth 332 of the adaptor 33 are provided for engagement with the annular teeth of the circular plate 31 to ensure that the adaptor 33 cannot rotate with respect to the circular plate 31.

As shown in FIG. 7, the first fastener 34 is disposed underneath the adaptor 33 and includes a head 342 and a threaded portion 341 axially extending from the head 342. The threaded portion 341 of the first fastener 34 extends through a central bore 41 of the mop head 40 and is screwed into the first threaded hole 323 of the other end portion 322 of the connecting member 32 and rests upon the shoulder 325 of the connecting member 32. The head 342 of the first fastener 34 abuts against a bottom surface 401 of the mop head 40. Moreover, the first fastener 34 defines a stepped hole 343 from top to bottom and in axial alignment with the second threaded hole 324 of the connecting member 32.

The second fastener 35 is provided to ensure that the first fastener 34 cannot rotate with respect to the connecting member 32. Specifically, the second fastener 35 has a head 352 and a threaded portion 351. The second fastener 35 runs through the stepped hole 343 of the first fastener 34 with its threaded portion 351 screwed into the second threaded hole 324 of the connecting member 32 and its head 352 resting against a shoulder of the stepped hole 343 of the first fastener 34. In this way, the first fastener 34 and the connecting member 32 are tightly joined together.

Referring back to FIG. 2, the central bore 41 of the mop head 40 includes a plurality of vertical grooves 441 in a peripheral wall thereof. The shaft portion 333 of the adaptor 33 is formed with ribs 334 in a periphery thereof to be engaged in the grooves 441 of the central bore 41 of the mop head 40 so as to enhance the bonding strength between the mop head 40 and the adaptor 33.

Figure 10:
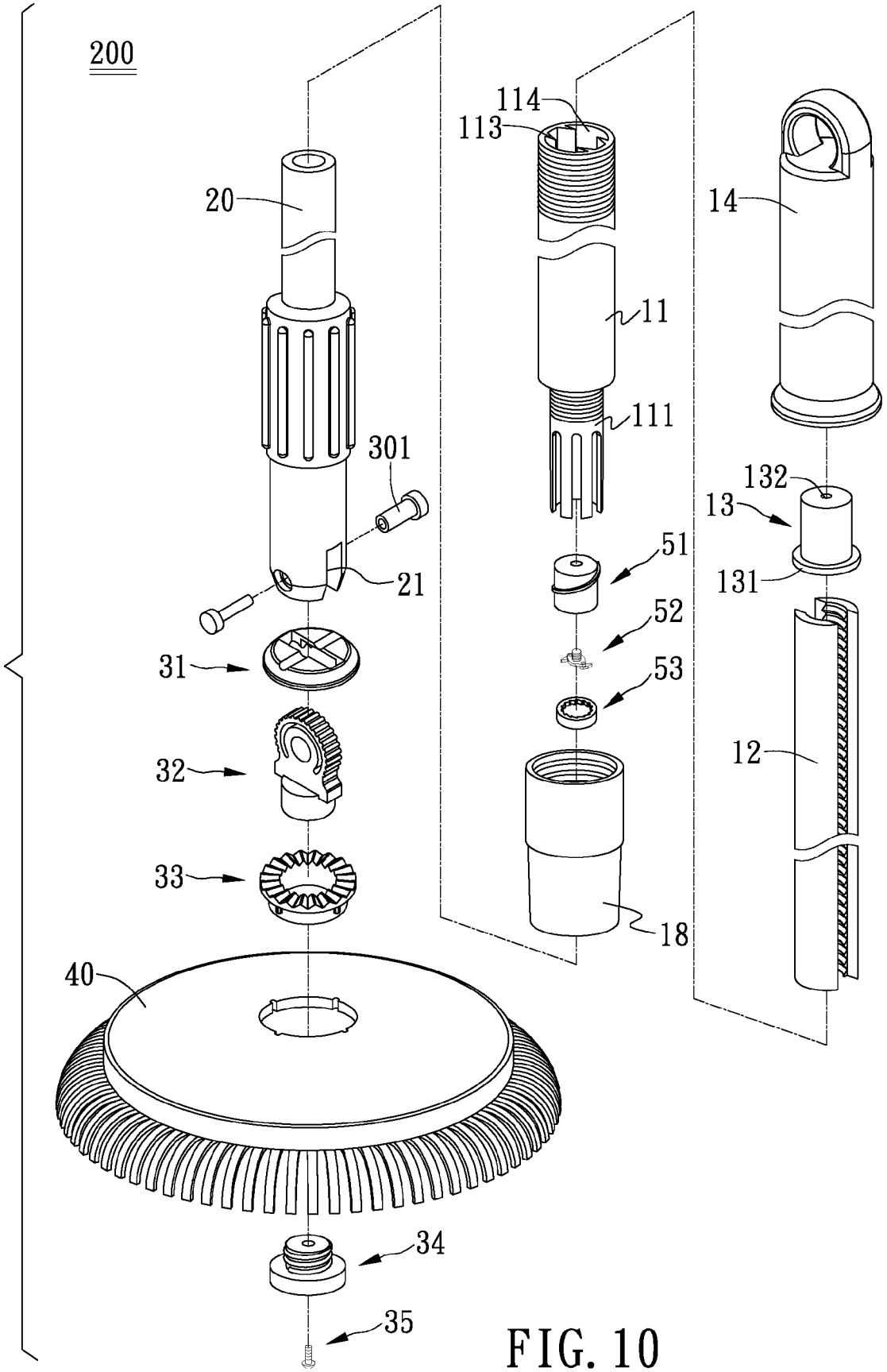
FIG. 10 is an exploded perspective view of a spin mop in accordance with a second embodiment of the present invention.
Figure 11:
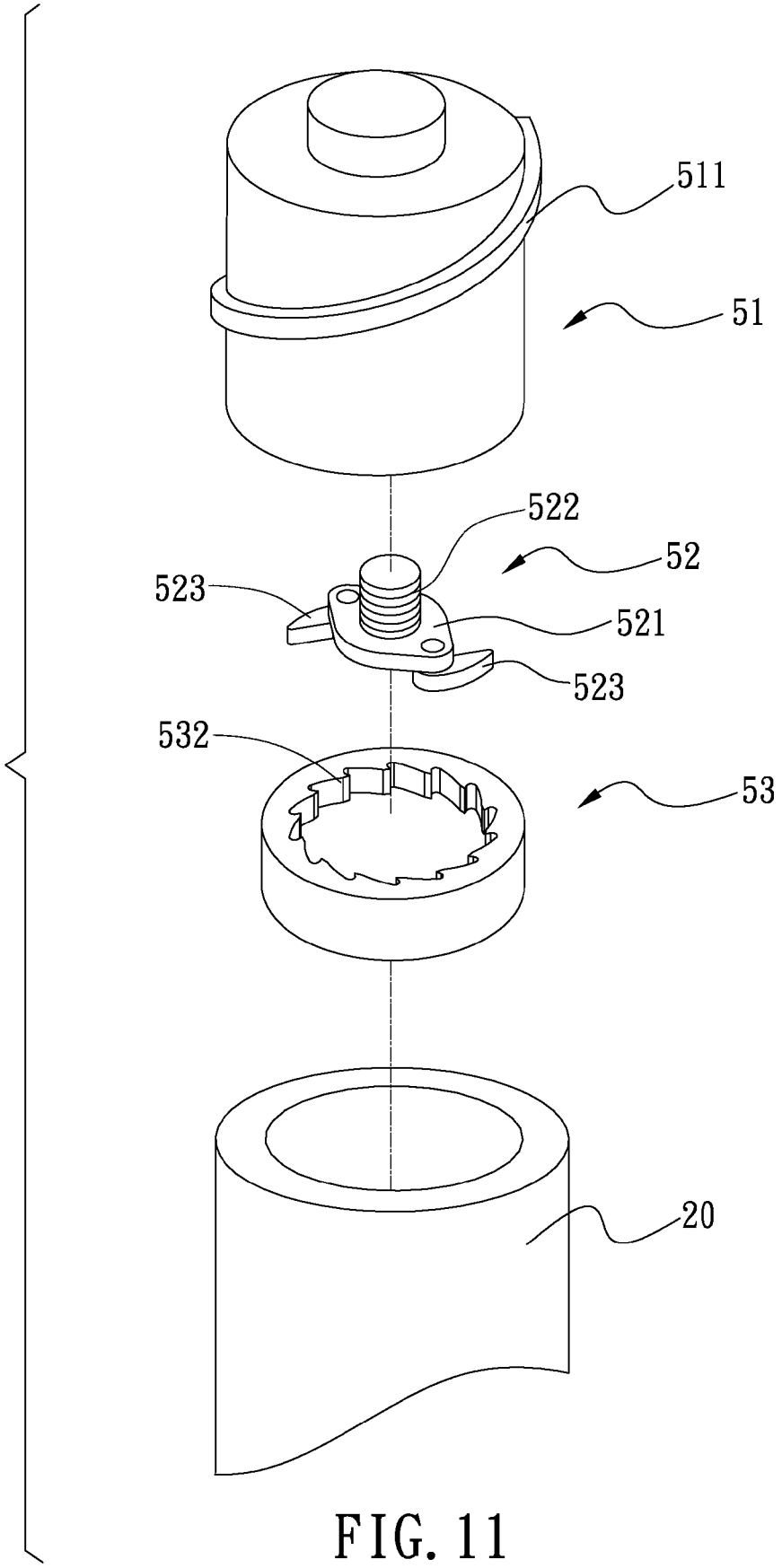
FIG. 11 is an enlarged perspective view of some parts of the spin mop shown in FIG. 10.
Figure 12:
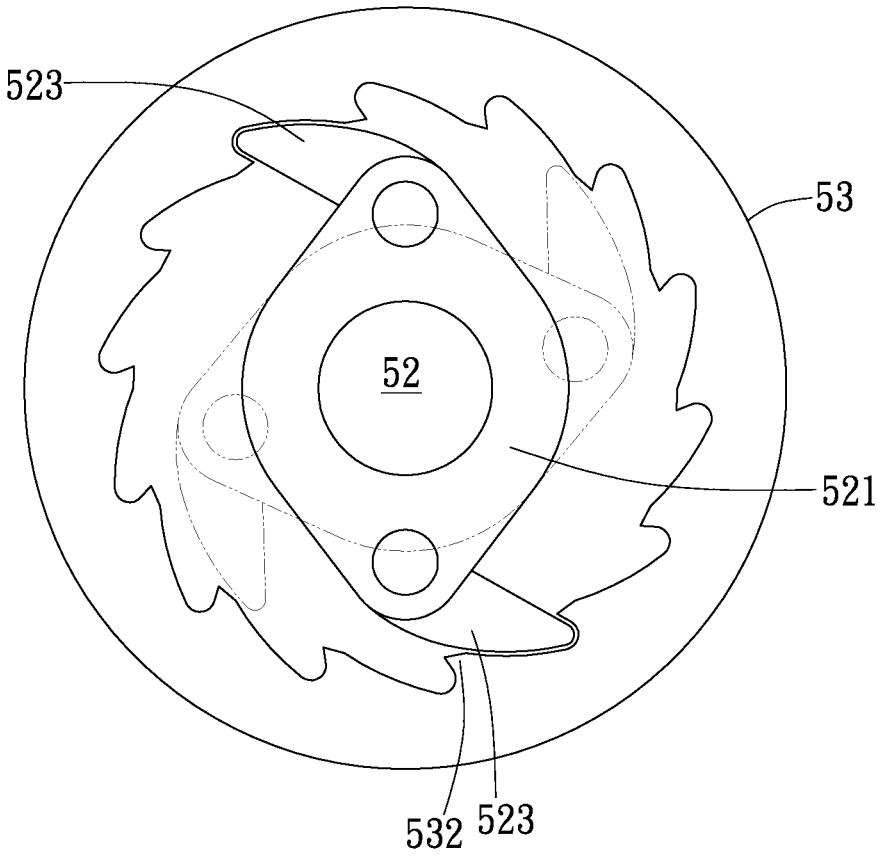
FIG. 12 is a top view of a clutch mechanism of the spin mop shown in FIG. 11.

With reference to FIGS. 10-12, a spin mop 200 is provided according to a second embodiment of the present invention. The spin mop 200 of the second embodiment is substantially identical to that of the first embodiment, except that the guide block 15 of FIG. 2 is replaced with a guide block including a cylindrical body 51 and a clutch member 52; and the follower 16 of FIG. 2 is replaced with a ratchet ring 53.

As best seen in FIG. 11, the cylindrical body 51 has a helical thread line 511 therearound. The clutch member 52 includes a disc 521, two pawls 523 disposed at opposite sides of the disk 521 and a threaded portion 522 extending upwardly from the center of the disk 521. The cylindrical body 51 defines at a bottom thereof a threaded hole (not shown) into which the threaded portion 522 of the clutch member 52 is screwed. The ratchet ring 53, serving as a follower, has internal teeth 532 for engagement with the pawls 523 of the clutch member 52, as shown in FIG. 12.

When the disk 521 rotates with the cylindrical body 51, the two pawls 523 of the disk 521 stretch outward, as shown by a solid line in FIG. 12, because of a centrifugal force generated by the rotation of the disk 521. At this time, the two pawls 523 of the disk 521 engage with the internal teeth 532 of the ratchet ring 53, and therefore the cylindrical body 51 and the clutch member 52 of the guide block together can drive the ratchet ring 53 as well as the lower rod 20 and the mop head 40 to rotate. In operation, when the upper rod 11 is pressed down to have the cylindrical body 51 enclosed by the stopper 13, the two pawls 523 of the disk 521 will slow down and finally retract to its original position and are released from the teeth 532 of the ratchet ring 53. After that, if the upper rod 11 is lifted up, the reversing rotation of the combination of the cylindrical body 51 and the clutch member 52 will not affect the normal spinning of the ratchet ring 53 as well as the lower rod 20 and the mop head 40.

As described above, the ratchet ring 53 is selectively driven by the guide block including the cylindrical body 51 and the clutch member 52, and wherein when the cylindrical body 51 is received in the recess 132 of the stopper 13, the clutch member 52 is kept from driving the ratchet ring 53 to rotate; and when the cylindrical body 51 is withdrawn from the recess 132 of the stopper 13, the clutch member 52 is free to drive the ratchet ring 53 together with the lower rod 20 to rotate.

It is to be understood that the disclosed embodiments are illustrative in nature and the invention is not to be limited to any one or more embodiments except as set forth in the following claims.

What is claimed is:

1. A spiral drive mechanism comprising:

an upper rod including a tube body, a tube extension extending from a bottom of the tube body and an annular shoulder defined at the junction of the tube body and the tube extension; the tube body having two sets of longitudinal ribs on inner walls thereof at two opposite sides; each set of the ribs defining a dovetail groove;

a sleeve axially secured around an upper portion of the tube body of the upper rod;

a stopper secured in the sleeve and having a recess defined in a bottom thereof and a flange formed at bottom edge thereof;

two thread rolling plates spaced apart and securely fitted in the respective dovetail grooves of the tube body of the upper rod and co-defining a threaded passage therebetween; and wherein the two thread rolling plates are held in between the annular shoulder of the upper rod and the flange of the stopper;

a guide block having a helical thread line on a periphery thereof and being placed in the threaded passage of the two thread rolling plates such that the guide block is movable in a spiral direction with respect to the thread rolling plates;

a lower rod axially movably inserted in the upper rod; and a follower secured on a top end of the lower rod and being selectively driven by the guide block, and wherein:

when the guide block is received in the recess of the stopper, the guide block is kept from driving the follower to rotate; and when the guide block is withdrawn from the recess of the stopper, the guide block is free to drive the follower together with the lower rod to rotate.

2. The spiral drive mechanism of claim 1 further comprising a spring, and wherein the guide block further has an axial bore defined from top to bottom thereof and a conical recess having teeth grooves at a bottom thereof; and the conical recess is in communication with the axial bore; the follower includes a cone body and a post which extends from the cone body and is slidingly mounted in the axial bore of the guide block; the cone body of the follower has teeth at a top thereof corresponding to the teeth grooves of the conical recess of the guide block for teeth engagement between the follower and the guide block; and the spring is disposed in the axial bore of the guide block and sleeved on the post of the follower.

3. The spiral drive mechanism of claim 1, wherein the guide block includes a clutch member and a cylindrical body with the helical thread line thereon; the clutch member includes a disc, two pawls disposed at opposite sides of the disk and a threaded portion extending upwardly from the center of the disk; and the cylindrical body defines at a bottom thereof a threaded hole into which the threaded portion of the clutch member is screwed; and the follower is a ratchet ring with internal teeth for engagement with the pawls of the clutch member.

4. A spin mop comprising:

an upper rod including a tube body, a tube extension extending from a bottom of the tube body and an annular shoulder defined at the junction of the tube body and the tube extension; the tube body having two sets of longitudinal ribs on inner walls thereof at two opposite sides; each set of the ribs defining a dovetail groove;

a sleeve axially secured around an upper portion of the tube body of the upper rod;

a stopper secured in the sleeve and having a recess defined in a bottom thereof and a flange formed at bottom edge thereof;

two thread rolling plates spaced apart and securely fitted in the respective dovetail grooves of the tube body of the upper rod and co-defining a threaded passage therebetween; and wherein the two thread rolling plates are held in between the annular shoulder of the upper rod and the flange of the stopper;

a guide block having a helical thread line on a periphery thereof and being placed in the threaded passage of the two thread rolling plates such that the guide block is movable in a spiral direction with respect to the thread rolling plates;

a lower rod axially inserted in the upper rod;

a follower secured on a top end of the lower rod and being selectively driven by the guide block, and wherein when the guide block is received in the recess of the stopper, the guide block is kept from driving the follower to rotate; and when the guide block is withdrawn from the recess of the stopper, the guide block is free to drive the follower together with the lower rod to rotate;

a connection mechanism; and a mop head connected to a bottom end of the lower rod by means of the connection mechanism.

5. The spin mop of claim 4 further comprising a spring, and wherein the guide block further has an axial bore defined from top to bottom thereof and a conical recess having teeth grooves at a bottom thereof; and the conical recess is in communication with the axial bore; the follower includes a cone body and a post which extends from the cone body and is slidingly mounted in the axial bore of the guide block; the cone body of the follower has teeth at a top thereof corresponding to the teeth grooves of the conical recess of the guide block for teeth engagement between the follower and the guide block; and the spring is disposed in the axial bore of the guide block and sleeved on the post of the follower.

6. The spin mop of claim 5, wherein the lower rod defines at the bottom end thereof a receiving recess and a pivot hole intersecting with the receiving recess and has two studs protruded at a bottom thereof and arranged in a line normal to the receiving recess; and the connection mechanism includes:

a pivot pin received in the pivot hole of the lower rod;

a circular plate having a through bore from top to bottom along a first diametrical direction, a trough in a top surface thereof along a second diametrical direction normal to the first diametrical direction, and annular teeth at a bottom thereof; and wherein when the two studs of the lower rod are seated in the trough of the circular plate, the lower rod is normal to the mop head;

a connecting member having one end portion pivotally mounted to the bottom end of the lower rod by means of the pivot pin, and the other end portion defining a first threaded hole therein;

an adaptor placed around the other end portion of the connecting member, and having a shaft portion at a bottom thereof and annular teeth at a top thereof for engagement with the annular teeth of the circular plate; and a first fastener disposed underneath the adaptor and including a head and a threaded portion axially extending from the head; and wherein the head of the first fastener abuts against a bottom surface of the mop head, and the threaded portion of the first fastener extends through a central bore of the mop head and is screwed into the first threaded hole of the other end portion of the connecting member.

7. The spin mop of claim 4, wherein the guide block includes a clutch member and a cylindrical body with the helical thread line thereon; the clutch member includes a disc, two pawls disposed at opposite sides of the disk and a threaded portion extending upwardly from the center of the disk; and the cylindrical body defines at a bottom thereof a threaded hole into which the threaded portion of the clutch member is screwed; and the follower is a ratchet ring with internal teeth for engagement with the pawls of the clutch member.

8. The spin mop of claim 7, wherein the lower rod defines at the bottom end thereof a receiving recess and a pivot hole intersecting with the receiving recess and has two studs protruded at a bottom thereof and arranged in a line normal to the receiving recess; and the connection mechanism includes:

a pivot pin received in the pivot hole of the lower rod;

a circular plate having a through bore from top to bottom along a first diametrical direction, a trough in a top surface thereof along a second diametrical direction normal to the first diametrical direction, and annular teeth at a bottom thereof; and wherein when the two studs of the lower rod are seated in the trough of the circular plate, the lower rod is normal to the mop head;

a connecting member having one end portion pivotally mounted to the bottom end of the lower rod by means of the pivot pin, and the other end portion defining a first threaded hole therein;

an adaptor placed around the other end portion of the connecting member, and having a shaft portion at a bottom thereof and annular teeth at a top thereof for engagement with the annular teeth of the circular plate; and a first fastener disposed underneath the adaptor and including a head and a threaded portion axially extending from the head; and wherein the head of the first fastener abuts against a bottom surface of the mop head, and the threaded portion of the first fastener extends through a central bore of the mop head and is screwed into the first threaded hole of the other end portion of the connecting member.

9. The spin mop of claim 4, wherein the lower rod defines at the bottom end thereof a receiving recess and a pivot hole intersecting with the receiving recess and has two studs protruded at a bottom thereof and arranged in a line normal to the receiving recess; and the connection mechanism includes:

a pivot pin received in the pivot hole of the lower rod;

a circular plate having a through bore from top to bottom along a first diametrical direction, a trough in a top surface thereof along a second diametrical direction normal to the first diametrical direction, and annular teeth at a bottom thereof; and wherein when the two studs of the lower rod are seated in the trough of the circular plate, the lower rod is normal to the mop head;

a connecting member having one end portion pivotally mounted to the bottom end of the lower rod by means of the pivot pin, and the other end portion defining a first threaded hole therein;

an adaptor placed around the other end portion of the connecting member, and having a shaft portion at a bottom thereof and annular teeth at a top thereof for engagement with the annular teeth of the circular plate; and a first fastener disposed underneath the adaptor and including a head and a threaded portion axially extending from the head; and wherein the head of the first fastener abuts against a bottom surface of the mop head, and the threaded portion of the first fastener extends through a central bore of the mop head and is screwed into the first threaded hole of the other end portion of the connecting member.

10. The spin mop of claim 9, wherein the shaft portion of the adaptor is formed with ribs in a periphery thereof and the central bore of the mop head includes grooves in a peripheral wall thereof to receive the ribs of the adaptor.

11. The spin mop of claim 9, wherein the other end portion of the connecting member further defines a second threaded hole and a shoulder formed at the junction of the first and second threaded holes; the threaded portion of the first fastener rests against the shoulder of the connecting member; the first fastener further defines a stepped hole from top to bottom and in axial alignment with the second threaded hole of the connecting member; the connection mechanism further includes a second fastener having a head and a threaded portion; and the threaded portion of the second fastener is screwed into the second threaded hole of the connecting member and the head of the second fastener abuts against a shoulder of the stepped hole of the first fastener.

* * * * *

UNITED STATES PATENT AND TRADEMARK OFFICE

CERTIFICATE OF CORRECTION

PATENT NO. : 8,739,347 B2
APPLICATION NO. : 13/557193
DATED : June 3, 2014
INVENTOR(S) : Yi-Pin Lin It is certified that error appears in the above-identified patent and that said Letters Patent is hereby corrected as shown below:

Title Page: Item (73)

The Assignees listed on the title page of the above-indicated patent are corrected to read as follows:

Yen-Tang Lin, Taichung (TW)
Dyna-Mop, Inc., Taipei (TW)

Signed and Sealed this
Seventeenth Day of March, 2015

Michelle K. Lee

Michelle K. Lee
*Director of the United States Patent and Trademark Office*